US006206614B1

(12) United States Patent
Blevins et al.

(10) Patent No.: US 6,206,614 B1
(45) Date of Patent: Mar. 27, 2001

(54) FLOATING OFFSHORE DRILLING/ PRODUCING STRUCTURE

(75) Inventors: Robert D. Blevins, San Diego; John E. Halkyard, Poway, both of CA (US); Edward E. Horton, III, Houston, TX (US)

(73) Assignee: Deep Oil Technology, Incorporated, Houston, TX (US)

( * ) Notice: Subject to any disclaimer, the term of this patent is extended or adjusted under 35 U.S.C. 154(b) by 0 days.

(21) Appl. No.: 09/067,060

(22) Filed: Apr. 27, 1998

(51) Int. Cl.[7] ..... B63B 35/44

(52) U.S. Cl. ..... 405/224; 405/224.2; 405/195.1; 114/264

(58) Field of Search ..... 405/203, 204, 405/205, 207, 223.1, 224, 224.1, 224.2, 224.3, 224.4, 195.1; 114/256, 264, 265, 266

(56) References Cited

U.S. PATENT DOCUMENTS 3,500,783 * 3/1970 Johnson, Jr. et al. ..... 114/264
3,572,041 * 3/1971 Graaf ..... 114/265
4,185,694 * 1/1980 Horton ..... 405/244.2
4,703,709 * 11/1987 Behar et al. ..... 114/256
4,740,109 * 4/1988 Horton ..... 405/224
5,558,467 * 9/1996 Horton ..... 405/224
5,683,206 * 11/1997 Copple ..... 405/224.2
5,722,492 * 3/1998 Finn ..... 405/224.2
5,722,797 * 3/1998 Horton, III ..... 405/224

* cited by examiner

*Primary Examiner*—Eileen D. Lillis
*Assistant Examiner*—Frederick L. Lagman
(74) *Attorney, Agent, or Firm*—Robert J. Edwards; D. Neil LaHaye

(57) ABSTRACT

A floating offshore drilling/producing structure. The structure is formed from a plurality of closely spaced vertically oriented buoyant columns on which one or more modules or decks may be placed to support process equipment, a drilling rig, utilities, and accommodations for personnel. The columns are held in the spaced relationship by a plurality of horizontal plates spaced along the length of the columns and vertical plates located near the bottom of the columns and near the top of the columns. Drilling and/or producing is accomplished through risers located approximately in the center of the structure. The structure includes fixed ballast, an oil storage area, and voids and variable ballast for offsetting the lighter weight of the stored oil. The columns have a smaller water plane area than the horizontal plates.

4 Claims, 7 Drawing Sheets

FLOATING OFFSHORE DRILLING/ PRODUCING STRUCTURE

BACKGROUND OF THE INVENTION

1. Field of the Invention

The invention is generally related to drilling and producing oil offshore and more particularly to floating structures used in such operations.

2. General Background

In the offshore oil industry, floating structures are used in areas where deep water results in the cost of a jacket fixed to the sea floor being too expensive to realize a sufficient economic return, even for large oil reserves. Such floating structures have been semi-submersibles, a column stabilized vessel that is moored in place by the use of multiple anchors, single column spar type structures, that are moored in place by multiple anchors, dynamically positioned vessels that use a number of thrusters to hold the vessel in position at the site, and tension leg platforms (TLP's).

Each structure has advantages and disadvantages. For example, while dynamically positioned vessels eliminate the need for anchors and mooring lines, they present a large surface area to waves and currents, which can result in a substantial amount of power required to hold the vessel in position. The large surface area also results in the vessel being subject to heave, pitch, and roll motions in response to wave action. The semi-submersibles present less surface area to waves and so are less susceptible to pitch and roll motions but are still subject to heave motions and are not designed to store large quantities of oil.

Minimizing environmentally induced motions is desirable not only from a safety and comfort standpoint, but also from an operational standpoint since drilling and producing through risers which are connected from the vessel to the sea floor wellhead must be designed to accommodate the motions of the structure. The cost of designing and building risers is directly related to the amount of heave, pitch, and roll of the structure, as well as the wave, current, and gravity forces acting on the risers themselves.

The TLP is relatively successful at minimizing heave, pitch, and roll. However, the TLP is a relatively shallow draft structure that is expensive and limited to moderate water depths. Further, it is virtually immobile once it has been installed.

The spar type structures (a single column hull such as that described in U.S. Pat. No. 4,702,321) are subject to vortex induced vibrations in high currents. This has been dealt with by including helical strakes along the length of the hull. Due to the large diameter of the hull, these structures must be built at a specially equipped construction facility. Also, as the diameter of these structures becomes larger, fabrication becomes more difficult. Transportation of a large spar type structure to the installation site, whether on a heavy lift vessel or by floating the completed hull, may also present difficulties. The disadvantages of the strakes required on single column spar structures in high currents are that they increase cost and increase drag, which in turn increases the cost of mooring.

SUMMARY OF THE INVENTION

The invention addresses the problems present in the larger spar type floating structures. What is provided is a deep draft floating structure that includes the benefits of the single column spar type of floating structures but eliminates some of the disadvantages. The structure of the present invention is formed from a plurality of closely spaced buoyant vertically oriented columns. The columns are held closely together by a plurality of horizontal and vertical plates spaced along the vertical axis of the structure. The vertical plates may include truss connections and are attached between the columns in the vicinity of the keel and near the water line of the structure. The horizontal plates increase the effective mass of the structure by entrapping water vertically. The vertical plates/truss connections serve the structural function of holding the columns in place vertically relative to each other and also serve to reduce surge motion from waves and reduce wave motion within the columns to protect the risers. A deck is supported above the water line on top of the columns. The entire structure may be moored or held in place by the use of dynamic positioning.

It is an object of the invention to provide a spar type of floating offshore structure that reduces vortex induced vibrations from ocean currents.

It is another object of the invention to provide a spar type floating offshore structure that has reduced drag loads from ocean currents.

It is another object of the invention to provide a spar type of floating offshore structure that reduces draft by increasing effective mass to water plane ratio.

It is another object of the invention to provide a spar type of floating offshore structure that reduces cost by providing the capability of the use of different construction and assembly methods.

BRIEF DESCRIPTION OF THE DRAWINGS

For a further understanding of the nature and objects of the present invention reference should be made to the following description, taken in conjunction with the accompanying drawings in which like parts are given like reference numerals, and wherein.

DETAILED DESCRIPTION OF THE PREFERRED EMBODIMENT

Figure 1:
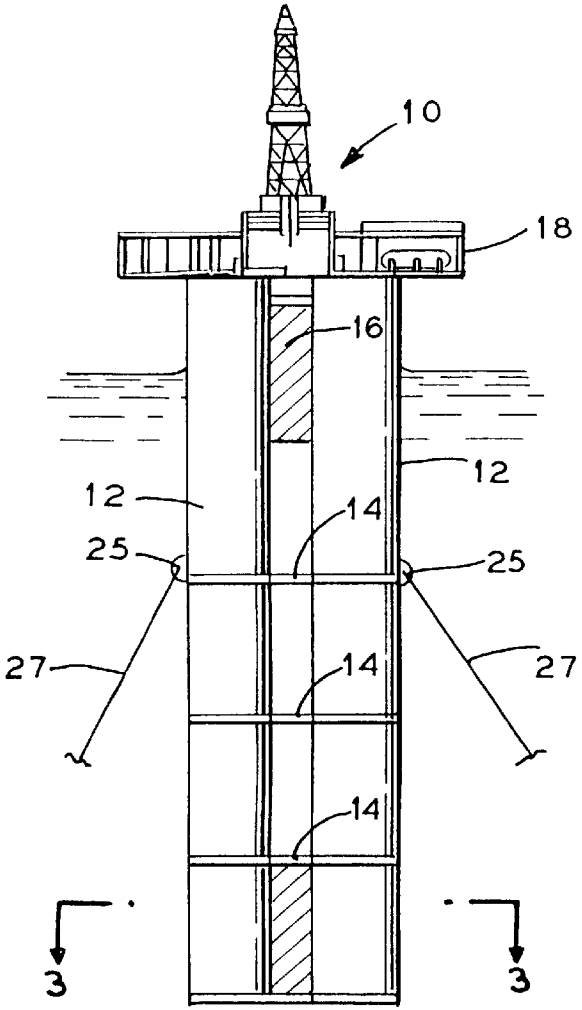
FIG. 1 is an outboard profile view of the invention.

Referring to the drawings, it is seen in FIG. 1 that the invention is generally indicated by the numeral 10. It can be seen in FIGS. 1–4 that floating offshore structure 10 is generally comprised of a plurality of vertically oriented buoyant hulls or columns 12, horizontal plates 14, and vertical plates 16. A topside or deck 18 is supported above the water by the upper end of the columns 12.

Horizontal plates 14 and vertical plates 16 each serve two functions. Both serve in a structural function to attach the columns 12 together in a closely spaced parallel arrangement adjacent each other.

Figure 3:
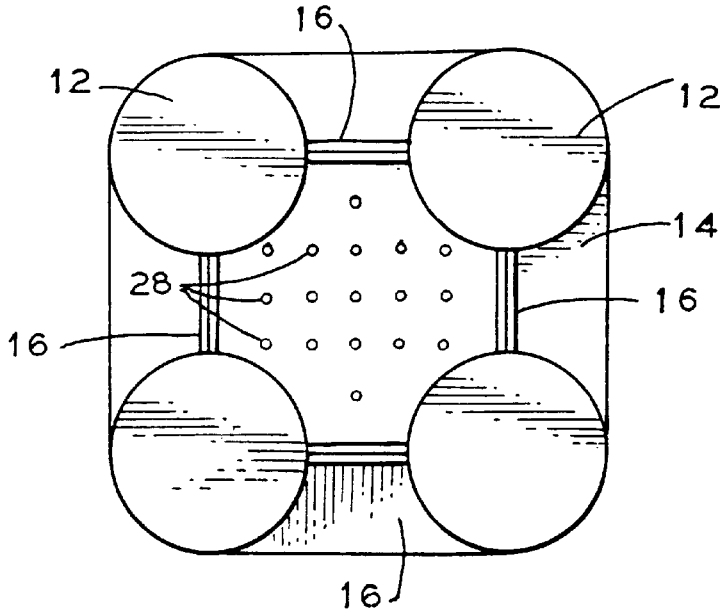
FIG. 3 is a view taken along lines 3—3 in FIG. 1.
Figure 4:
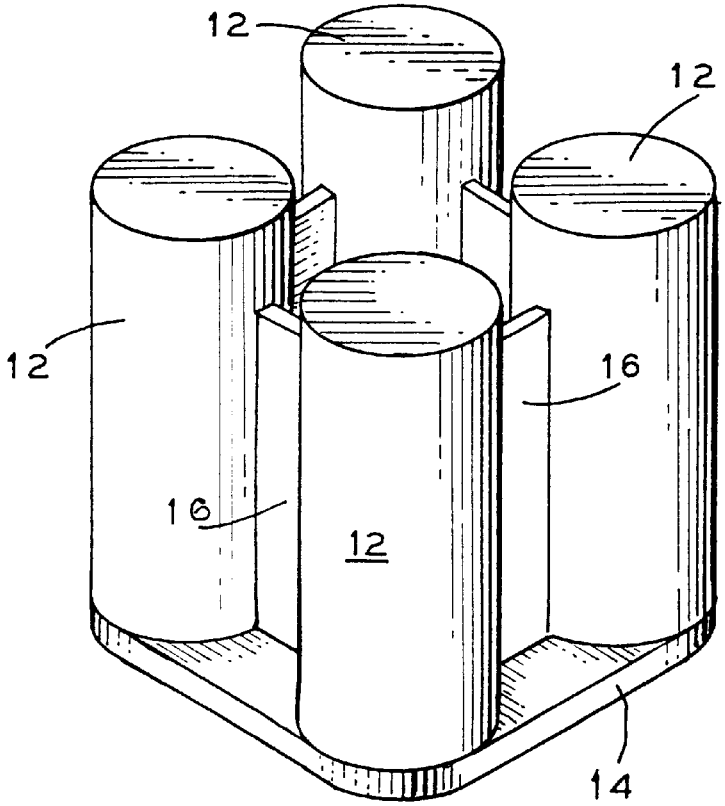
FIG. 4 is a perspective section view of the lower portion of the invention.

Horizontal plates 14 also serve as water entrapment plates to entrap water in the vertical direction. This increases the effective mass of the overall structure and therefore increases the natural period of the structure in overall heave (up/down motion) so that it is longer than that of the energy band of the waves. The working principle of the horizontal plates 14 is fully explained in U.S. Pat. No. 5,558,467. As seen in FIG. 3, horizontal plates 14 are provided with slots or bores 28 therethrough to receive risers used in drilling and production operations. Horizontal plates 14 are spaced along the vertical length of columns 12, preferably start well below the water line where the wave action is low, and extend to the lower end of the columns 12.

The horizontal plates 14 result in the ability of the structure to be built with less draft than a comparable single hull spar structure because the horizontal plates entrap water, thereby increasing the effective mass of the structure in the vertical direction. The natural period of the structure in heave is approximately given by the following equation:

$$T = 2\pi\sqrt{M/K}$$

Where T =Natural Period;

M =Mass of the structure including the mass of water entrapped between the plates; and K =The spring constant of the system which is a function of the area of water plane at the water line.

In the invention, the water plane area of the structure 10 is less than the horizontal plane area of the entrapment plates. Thus, the longer period will be attained at less draft than that of the spar structure described in U.S. Pat. No. 4,702,321.

Vertical plates 16 may either be solid shear plates or a combination of solid shear plates and an open truss. Vertical plates 16 are preferably positioned at the lower end of the columns in the vicinity of the keel and near the upper end of the columns, at the water line. Near the lower end, in the vicinity of the keel, the solid shear plates serve to entrap water horizontally and reduce surge motion. Near the upper end, below the normal water line, the vertical plates 16 reduce wave motion within the envelope defined by the hulls 12. The reduced wave motion within the columns helps to protect the risers and reduces the changes in water height between the columns during heavy seas.

Each column 12 is provided with a similar configuration of hard buoyancy tanks 20, one or more soft tanks 22, and fixed ballast 24. Fairleads 25 are provided at selected positions to receive mooring lines 27. At least one of the hard buoyancy tanks 20 is capable of taking on variable ballast in the form of sea water, designated by numeral 26. Soft tanks 22 are equalized with the ambient pressure by flooding with sea water and/or being used to store oil.

The multi-column structure of the invention is less susceptible to vortex induced vibration because the adjacent columns are preferably separated by gaps of approximately one tenth to three times their diameter to allow an interstitial flow of water between the columns. The close proximity of adjacent columns suppresses the formation of vortices between columns. A distance of approximately four cylinder diameters is required for formation of vortices in the wake of cylindrical columns in the high Reynolds number current environment. As seen in the flow diagram of FIG. 5, the preferred spacing between columns does not allow for formation of large vortices between columns. The effect of the interstitial flow on decorrelating vortex shedding occurs regardless of the flow direction.

The period of vortex shedding from the overall multi-column design is proportional to its overall width D. The vortex induced oscillations occur when the period of vortex shedding coincides with the natural period T of the multi-column design on its moorings. This condition is given by the following formula:

$$5 < UT/D < 8$$

By increasing the spacing between columns, D is increased and the minimum current velocity U for vortex-induced oscillations can be raised above the current velocity at any particular site. Thus, the spacing and diameter of the columns design can be tailored for a particular site to avoid vortex-induced vibration. As a result, vortex-induced vibration suppression devices are not generally required on the multi-column design, reducing drag.

Figure 5:
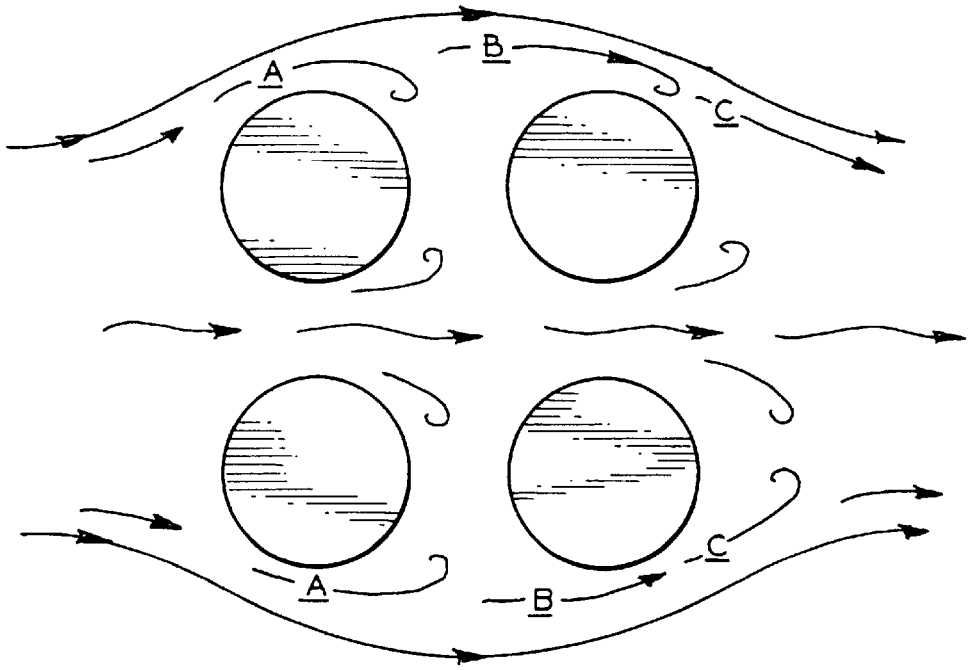
FIG. 5 is a flow diagram that illustrates water flow around the invention.

As seen in FIG. 5, the two upstream columns shield the two downstream columns from the incoming flow, greatly reducing or eliminating positive pressure drag on the forward face of the upstream columns. Second, the current flow detaches at point A from the upstream side of the upstream columns and is reattached to the downstream columns at point B. The flow remains attached to the downstream side of the downstream columns until point C. This reattachment of flow greatly reduces the wake, the extent of the low pressure region in the wake and the wake drag. Thus, the positioning of the columns allows the external flow to form a virtual streamlined shape of flow about the columns that has lower drag than a single cylinder of equivalent area in the same current.

Figure 6:
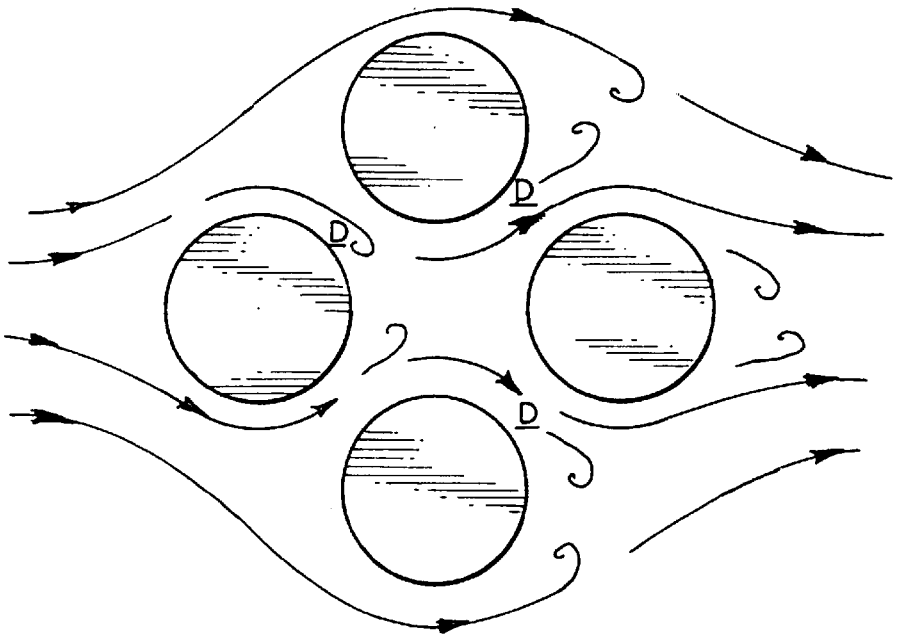
FIG. 6 is a flow diagram that illustrates water flow around the invention at a different angle from FIG. 5.

As seen in FIG. 6, where the columns face the current in a diamond formation, the interstitial flow also maintains the boundary layer over the rearward face of the upstream columns, which minimizes drag. Thus, the drag reduction effect of closely spaced columns occurs regardless of the flow direction.

Although an initial look at the structure 10 may give the impression that the structure is simply a very deep draft semi-submersible, such as that described in U.S. Pat. No. 4,983,073, this is not the case. In structure 10, the hulls 12 are not connected together by horizontal pontoons, and the spacing between the hulls 12 is much closer. Also, the structural integrity of the structure is developed by the horizontal and vertical plates 14, 16. Further, the hydrodynamic stability of the structure is developed by the fact that the center of gravity is well below the center of buoyancy. The moment of inertia of the water plane is a minor contribution to the metacentric height.

Figure 2:
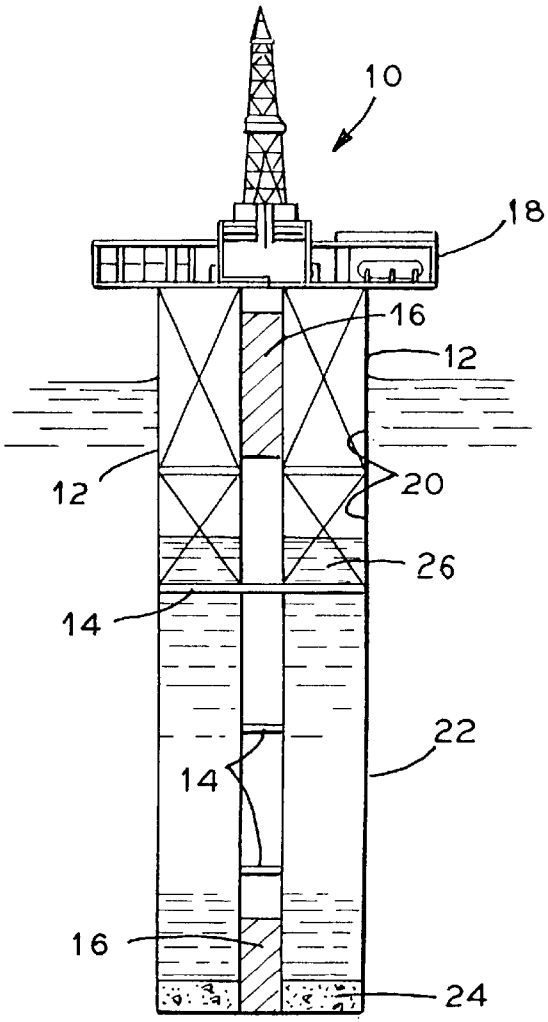
FIG. 2 is a cross section view of the invention.
Figure 7:
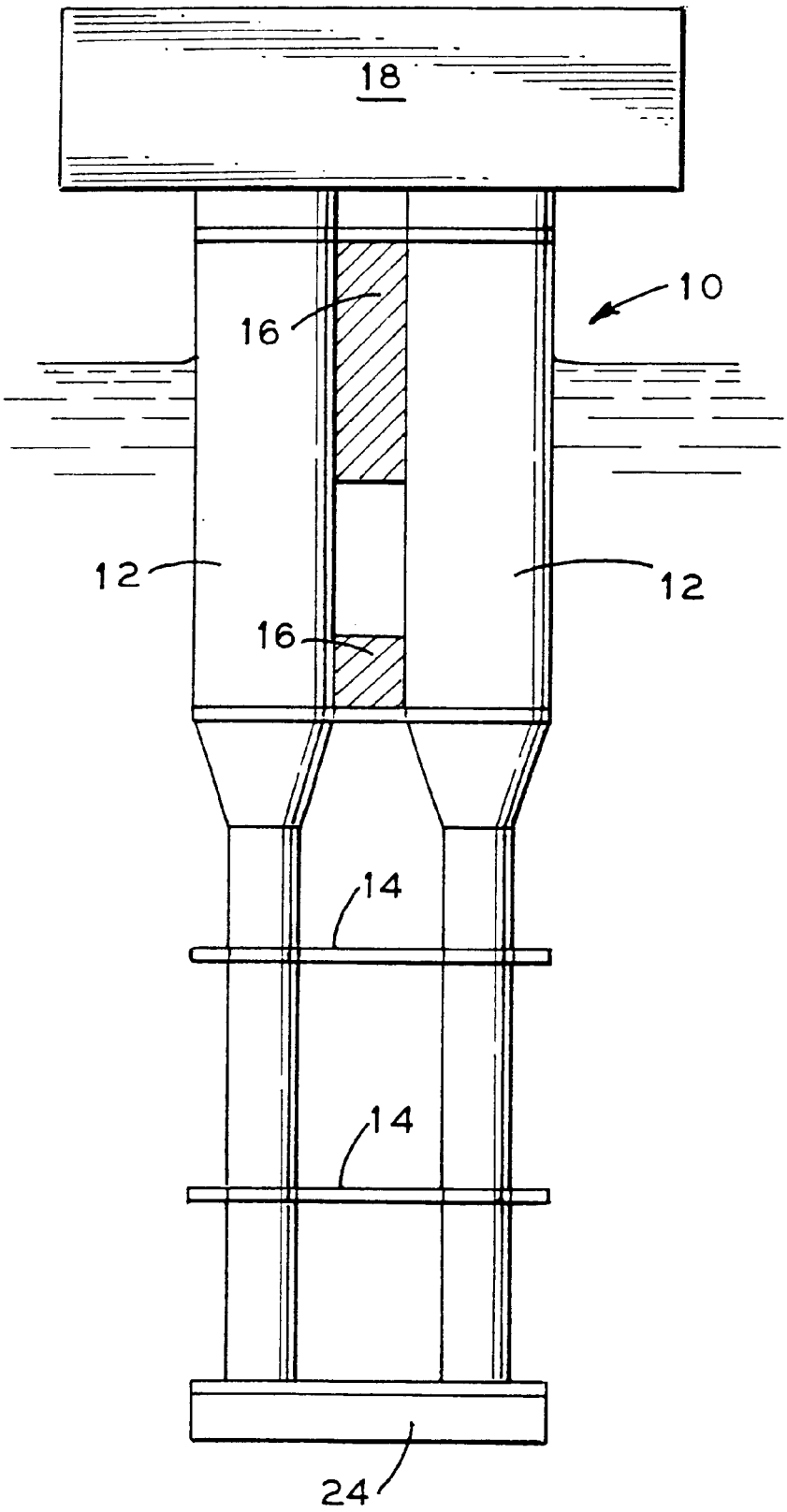
FIG. 7 illustrates an alternate embodiment of the invention.

FIG. 7 illustrates an alternate embodiment of the invention where the lower portion of each column has a reduced diameter from the upper portion of the column. The reduced diameter portion is located below the hard tank sections, as illustrated in FIG. 2. The reduced diameter of the lower portion of the columns will provide the advantage of reduced structural weight as well as reduced drag loads from currents.

Figure 8:
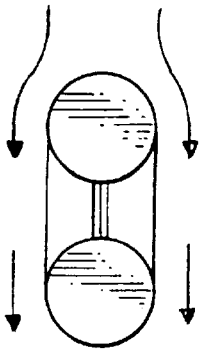
FIGS. 8–12 are top sectional views of alternate embodiments of the invention.

FIG. 8 is a top sectional view of an alternate embodiment of the invention utilizing two columns 12, and also illustrates current flow around the columns 12. As seen in the flow diagram, the drag is lower than would be expected due to sheltering of the downstream column by the upstream column and by reattachment of the flow on the downstream cylinder.

Model tests have shown that the drag coefficient of two closely spaced cylinders is less than a single cylinder of equivalent enclosed area. Thus, the structure of the invention has less drag from ocean currents. The reduction in drag of multiple closely spaced columns in high Reynolds number environments is the result of the shielding of downstream columns by upstream columns and by the attachment of the turbulent boundary layer on the downstream side of the columns, thereby minimizing their wake drag.

Figure 10:
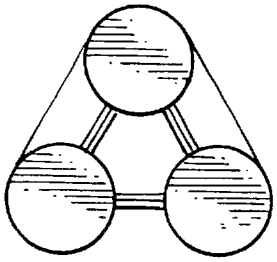
Figure 11:
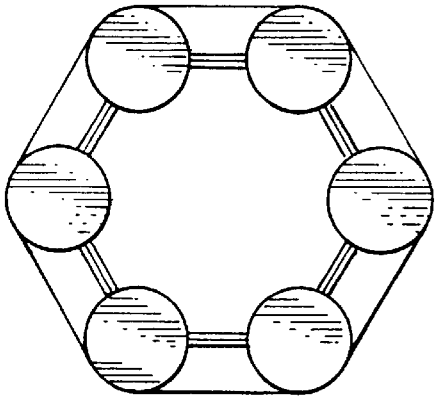
Figure 12:
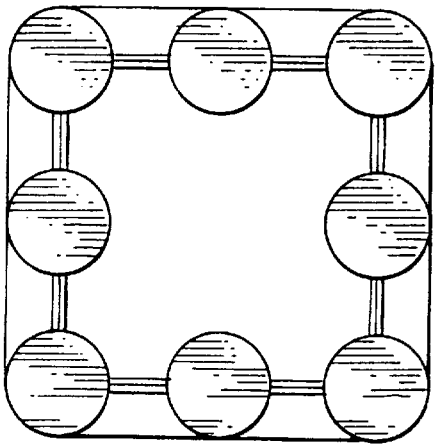

FIGS. 10–12 illustrate different arrangements of the invention where three, six, or eight columns may be used. Two or three columns may be used for relatively small structures with light deck loads, while six and eight columns may be used for relatively large structures with heavy deck loads.

Figure 9:
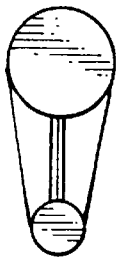

FIG. 9 illustrates an arrangement of two columns where the downstream column has a smaller diameter than the upstream column. By using a smaller diameter for the downstream column, the oscillating vortex forces on the downstream column are minimized, an inherently hydrodynamically stable configuration is produced, and drag can be further reduced for optimum gap spacing between one tenth and one times the diameter of the upstream column.

Because of the low drag coefficient of the two column structure, it may lend itself to being dynamically positioned.

Figure 13A:
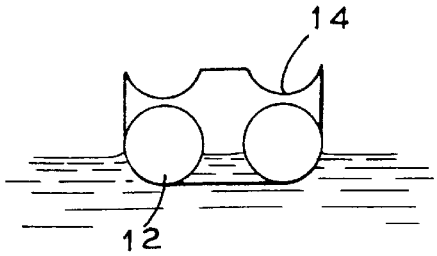
FIGS. 13A–C illustrate a method of assembling the columns of the invention into a single structure.
Figure 13B:
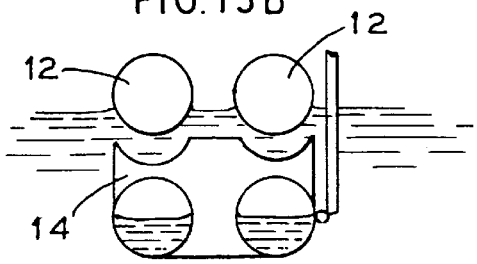
Figure 13C:
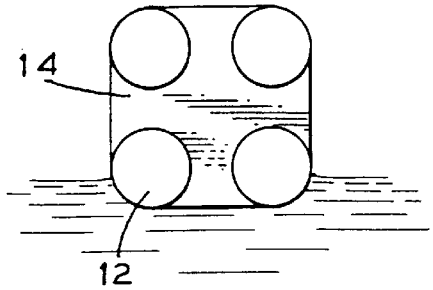

FIGS. 13A–C illustrate a means for assembly of the invention. Two of the columns 12 that have been attached together with one section of a horizontal plate 14 are submerged to a suitable depth by ballasting such that the remaining columns to be attached may be floated over the horizontal plate. The lower two columns are deballasted to raise the upper two columns above the water line to allow weld up and attachment of the remainder of the horizontal plate to the upper columns. This method of assembly, as opposed to full assembly in a fabrication yard, is useful where the structure 10 must be towed through shallow water and the draft of the completed four column structure would be greater than the depth of the shallowest waters of the tow out.

It should be understood that the columns 12 may be formed from any suitable material such as steel or concrete. If formed from concrete, the columns may be slip formed at a suitable deep water site. Slip forming columns with concrete is a construction method well known in the industry.

Figure 14:
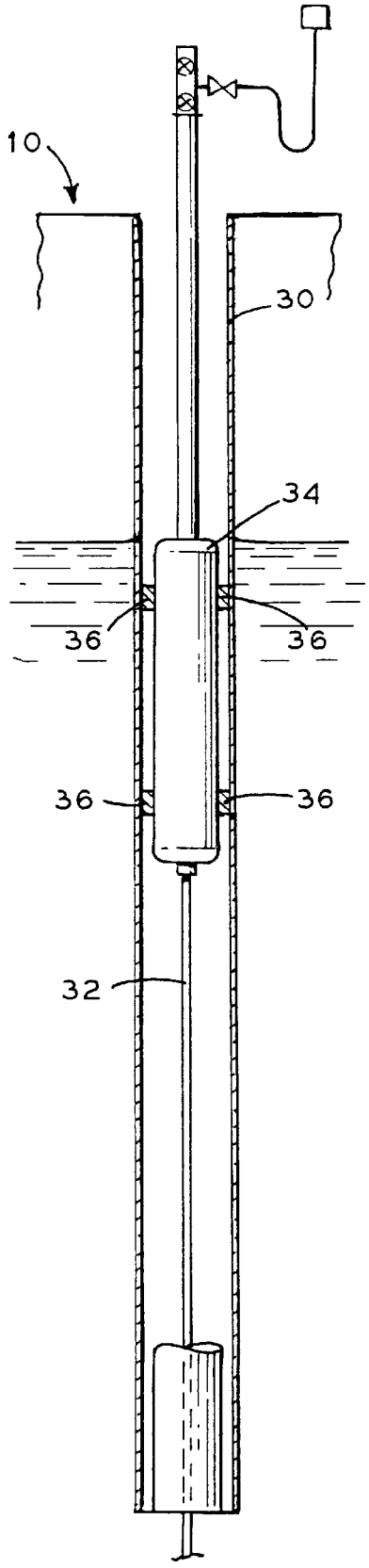
FIG. 14 illustrates the use of a sleeve attached to the structure to protect the riser.

FIG. 14 illustrates a riser sleeve 30 that is provided to protect the riser 32 and buoyancy module 34 from turbulent water. The riser sleeve 30 is attached to the structure 10 and extends downwardly from above the water line to a depth beyond significant wave energy. The riser sleeve 30 is open at both ends and sized to receive the riser 32 and buoyancy can 34. Guides 36 may be provided on the buoyancy can 34 to prevent hangups and to minimize wear on the sleeve 30 and buoyancy can 34.

Figure 15:
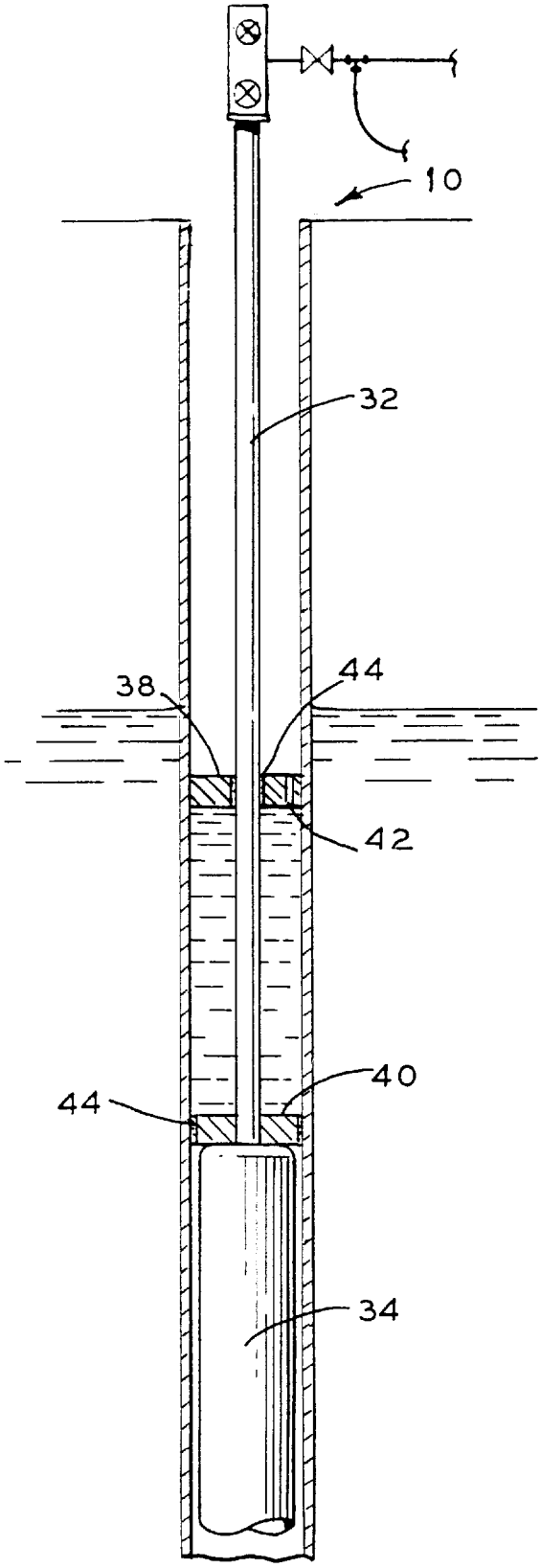
FIG. 15 illustrates flow control means provided in conjunction with the sleeve of FIG. 14.

FIG. 15 illustrates an optional arrangement for the riser sleeve 30 and buoyancy can where a first plate 38 is rigidly attached to the inside of the riser sleeve 30 below the water line and closely received around the portion of the riser 32 above the buoyancy can 34 for sliding movement therearound. A second plate 40 is rigidly attached to the portion of the riser 32 immediately above the buoyancy can 34 and closely received within the sleeve 30 for sliding movement therein. The plates 38, 40 define a space with a volume that varies in direct proportion to the position of the buoyancy can 34; the closer the buoyancy can to the water surface, the less the volume of water between the plates 38, 40. The first plate is preferably provided with means 42 for controlling the rate of change in water volume between the plates in response to movement of the buoyancy module, which could be due to riser failure. Control means 42 may be as simple as the orifice illustrated or a valve. Controlling the rate at which the water volume changes limits the velocity of the buoyancy can 34 in the event of a riser failure below the buoyancy can. This serves to eliminate or minimize damage to the structure 10, buoyancy can 34, and remaining portions of the riser 32. Sliding seals 44 may be provided on both plates.

Because many varying and differing embodiments may be made within the scope of the inventive concept herein taught and because many modifications may be made in the embodiment herein detailed in accordance with the descriptive requirement of the law, it is to be understood that the details herein are to be interpreted as illustrative and not in a limiting sense.

What is claimed as invention is:

1. A catenary moored spar-like floating offshore drilling/producing structure having its center of gravity below its center of buoyancy and its natural period longer than the peak wave energy period, comprising:

a. a plurality of vertically oriented buoyant columns in closely spaced arrangement adjacent each other;

b. drilling and production risers located within the interior portion of the multiple column assembly;

c. a plurality of horizontal plates that extend to the perimeter of the column assembly and that connect the lower portion of the column assembly together and fix the lower portion of each column's horizontal position relative to each other and are sized to entrap a sufficient mass of water to increase the natural heave period of said structure such that it is longer than the peak energy wave period, said plates being spaced along the length of said column assembly and located below the water level at a distance below significant wave energy;

d. a plurality of vertical plates connecting the upper portion of the column assembly together and fixing this portion of each column's vertical position relative to each other, said vertical plates being located in the wave zone and extending above and below the still water line so that the risers are protected from wave forces; and e. vertical plates connecting the lower portions of the columns together and fixing the vertical relationship of the columns relative in the horizontal to each other and providing additional mass to the structure in this region to reduce surge motion.

2. The structure of claim 1, wherein the spacing between said columns is approximately one tenth to three times the diameter of the columns.

3. The structure of claim 1, wherein said columns include variable ballast means.

4. In an offshore structure designed to drill for and produce hydrocarbons and having a riser independently supported by a buoyancy module, the improvement comprising:

a. a sleeve rigidly attached to the offshore structure and received around the riser and buoyancy module, said sleeve being open at both ends and extending from above the water line downward to a depth beyond significant wave energy;

b. a first plate rigidly attached to the inside of said sleeve below the water line and closely received around the riser;

c. a second plate rigidly attached to the riser above the buoyancy module and closely received inside said sleeve; and;

d. means on said first plate for controlling the rate of change in water volume between said plates in response to movement of the buoyancy module.

* * * * *